US005261161A

United States Patent [19]

Lee

[11] Patent Number: 5,261,161

[45] Date of Patent: Nov. 16, 1993

[54] ELECTRIC VACUUM SHAVER

[76] Inventor: Chulhee Lee, 4009 Postgate Ter. #304, Silver Spring, Md. 20906

[21] Appl. No.: 663,479

[22] Filed: Mar. 4, 1991

[51] Int. Cl.[5] ..... B26B 19/44

[52] U.S. Cl. ..... 30/41.5; 30/41.6; 30/43.1; 30/43.92; 30/133

[58] Field of Search ..... 30/43.1, 43.2, 43.92, 30/41.5, 41.6, 133, 201, 202, 43

[56] References Cited

U.S. PATENT DOCUMENTS

| | | | |
|---|---|---|---|
| 761,808 | 6/1904 | Allen | 30/41.5 |
| 2,129,559 | 9/1938 | Blackwell | 30/41.5 |
| 2,183,442 | 12/1939 | Blackwell | 30/41.5 |
| 2,238,148 | 4/1941 | Zahn | 30/41.5 |
| 2,716,279 | 8/1955 | Peterson | 30/41.5 |
| 3,128,549 | 4/1964 | Hubbartt et al. | 30/41.5 |
| 3,224,305 | 12/1965 | Silver et al. | 30/41.5 X |
| 3,339,276 | 9/1967 | Tolmie et al. | 30/43.1 X |
| 3,793,724 | 2/1974 | Messinger et al. | 30/43.1 X |
| 4,417,397 | 11/1983 | Kitamura | 30/41.6 X |

FOREIGN PATENT DOCUMENTS 2074322 10/1981 United Kingdom ..... 30/43

*Primary Examiner*—Hien H. Phan
*Assistant Examiner*—Raymond D. Woods

[57] ABSTRACT

An electric vacuum shaver incorporating a vacuum to effectively draw long thin hair into the shearing foil. A space control device is provided so that a vacuum can be better utilized and a proper space can be maintained between the shearing foil and the skin to help long hair to be effectively drawn into the shearing foil without being pressed. The shearing foil and the cutter can be designed in special shapes cooperating with the enclosure to accommodate various hair conditions without adjusting the space between the skin and the shearing foil. Optionally, a disconnecting device is provided to disconnect power to the fan when there is little space between the shearing foil and the skin to prevent the shearing foil from sticking to the skin.

14 Claims, 13 Drawing Sheets

ELECTRIC VACUUM SHAVER

BACKGROUND OF THE INVENTION

This invention relates to an electric shaver which can create a vacuum inside a shearing foil such that hair along with air is drawn into the shaver through the shearing foil. As a result, hair, especially long thin hair, can be shaved effectively.

Electric shavers are widely used for convenience and safety. Most electric shavers with inner blades comprise a shearing foil, a cutter cooperating with the shearing foil, and an electric motor which drives the cutter. The electric shaver works in the following way: As a user moves an electric shaver over the skin with some pressure, hair comes in through the shearing foil and the rotating or reciprocating cutter cuts the hair. Therefore, although conventional electric shavers with inner blades are effective in shaving short stiff hair, which enters easily through the shearing foil, they are not effective in shaving long thin hair.

Electric vacuum shavers have been known for many years. Although the vacuum helps to draw hair into the shearing foil and to collect particles of cut hair and skin matter, there is a problem with cutting relatively long hair. When long hair is pressed by the shearing foil, the long hair has difficulty entering the shearing foil in spite of the vacuum. To effectively cut relatively long hair, a user must initially maintain a proper space between the skin and the shearing foil and gradually reduce the space between them. This is rather awkward and difficult. The present invention solves this problem with space control means which maintains a proper space between the shearing foil and the skin to help long hair to be effectively drawn into the shearing foil without being pressed. In addition, the shearing foil and the cutter can be designed in special shapes in cooperation with an enclosure to accommodate various hair conditions without adjusting the enclosure.

The vacuum inside the shearing foil often makes the shearing foil stick to the skin when there is little space between them, resulting in discomfort. This problem is solved with an automatic cut-off switch which disconnects power to the fan when there is little space between the shearing foil and the skin, preventing the shearing foil from sticking to the skin.

Therefore, it is an object of the present invention to provide an electric vacuum shaver space control means so that vacuum can be better utilized and a proper space can be maintained between the shearing foil and the skin to help long hair to be effectively drawn into the shearing foil without being pressed.

Another object of the present invention is to design the shearing foil and the cutter in special shapes in cooperation with an enclosure to accommodate various hair conditions without adjusting the enclosure.

A further object of the present invention is to provide the electric vacuum shaver disconnecting means which disconnects power to the fan when there is little space between the shearing foil and the skin, preventing the shearing foil from sticking to the skin.

SUMMARY OF THE INVENTION

Although electric shavers are convenient and safe, it is difficult to shave long thin hair since it has difficulty entering the shearing foil. According to the present invention, means to create a vacuum inside the shearing foil is provided for an electric shaver so that long thin hair can easily enter through the shearing foil as air is drawn in.

Means to create a vacuum inside the shearing foil can be easily provided by adding a fan to an electric shaver. It may be necessary to add a separate electric motor or at least to use a separate shaft to drive the fan in order to generate enough vacuuming power. The cutters of most electric shavers fall into two categories: a rotating cutter and a reciprocating cutter. In the case of the rotating cutter, the fan can be attached to the same shaft which drives the rotating cutter. However, in this case, the RPM(revolutions per minute) stay the same and sufficient vacuuming power may not be generated. In order to generate enough vacuuming power, a separate motor or at least a separate shaft can be used. In the case of the reciprocating cutter, a separate shaft or a separate motor is necessary to drive a fan.

So that hair can be drawn in effectively along with air, there must be a space between the shearing foil of an electric vacuum shaver and the skin. Otherwise hair, especially long hair, is pressed against the skin by the shearing foil and has difficulty entering through the shearing foil even though there is a vacuum inside it. If hair is long and thin, more space is needed. As hair is being cut short, the space can also be reduced. Therefore there is a need to control the space between the shearing foil and the skin as hair is being cut. For this purpose, space control means is provided. The space control means which is placed on the circumference of the shearing foil comprises a receptacle, an enclosure which is moveably placed within the receptacle and can be elevated above the shearing foil, and changing means which changes the position of the enclosure within the receptacle. Adjusting the space between the shearing foil and the skin can be accomplished by changing the position of the enclosure within the receptacle either manually or automatically. To adjust the space between the shearing foil and the skin automatically, an elastic body can be installed between the enclosure and the receptacle to that as force is applied to the enclosure, the enclosure is pushed into the receptacle resulting in reduced space between the shearing foil and the skin. Thus the user can cut long hair to a certain length in the first operation and then by pressing the shaver further, the user can shave the hair short.

A problem with the electric vacuum shaver is that when there is little space between the shearing foil and the skin, the skin tends to stick to the shearing foil due to the vacuum inside it resulting in difficulty moving the shaver and discomfort. This problem is overcome by disconnecting means which disconnects power to the fan if the space between the shearing foil and the skin is smaller than a threshold.

By making the shearing foil partly slanted, long hair can also be shaved short without adjusting the space between the shearing foil and the skin. For instance, part of the shearing foil is flat and at about the same height as the enclosure, ensuring a short cut of hair, while the other part of the shearing foil is slanted such that long hair can gradually be shaved skin close. Thus long thin hair can be effectively drawn in through the shearing foil and cut to an intermediate length at the slanted part of the shearing foil, and then the hair will be shaved skin close at the flat part of shearing foil. This will be better understood with the help of drawings.

In this invention, an enclosure placed around the shearing foil, with openings in the enclosure to allow air to flow, makes it possible to utilize vacuum effectively. With the enclosure, the degree of vacuum between the skin and the shearing foil increases and the hair is more effectively drawn in. Therefore the purpose of the enclosure can be twofold: (a) to adjust the space between the shearing foil and the skin, and (b) to utilize the vacuum more effectively.

Other objects, features, and advantages of the invention appear from the disclosure hereof.

BRIEF DESCRIPTION OF THE DRAWINGS

FIG. 20 shows a top view of a shearing foil which is flat in the middle and in the rim and slanted in between.

DESCRIPTION OF THE ILLUSTRATED EMBODIMENTS

Figure 1:
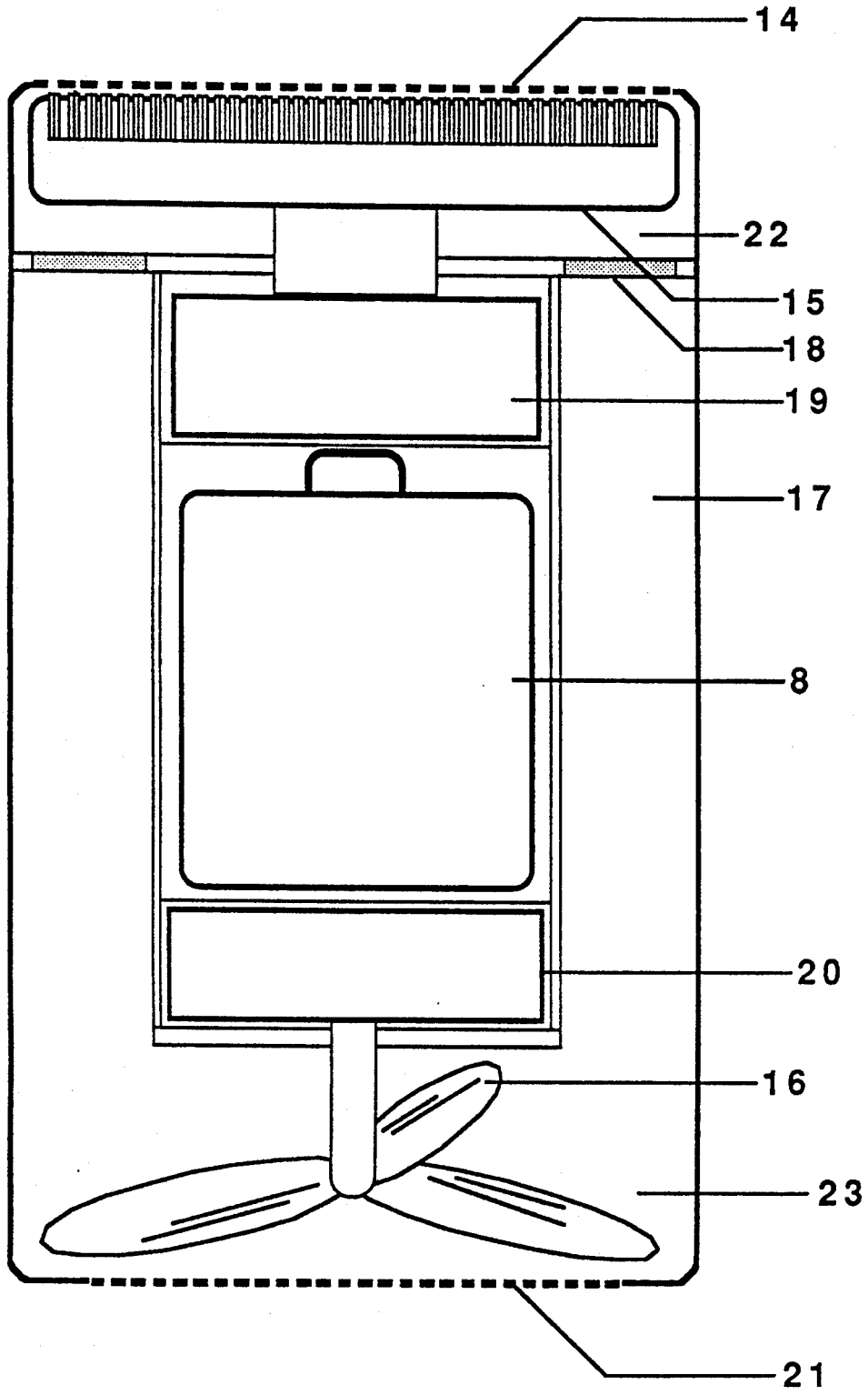
FIG. 1 shows a cross-sectional view of an electric vacuum shaver with a reciprocating cutter which has a separate motor to drive the fan.

FIG. 1 shows an example of the electric vacuum shaver which has separate shafts for a cutter 15 and a fan 16. In this example, the fan compartment 23 containing the fan 16 is placed at the bottom of the electric shaver and the two compartments are connected by air tunnels 17. There is a filter 18 between the air tunnels 17 and the cutter compartment 22 containing the cutter 15 in order to block cut hair while allowing air to flow. In this example, two motors are used, one 19 for the cutter and the other 20 for the fan. As the fan 16 rotates, air flows out through the openings 21 and a partial vacuum is formed in the air tunnels 17 and the cutter compartment 22. Therefore air enters through the shearing foil 14, passes through the filter 18 and the air tunnels 17, and goes out through the openings 21. Along with air, hair is also drawn in through the shearing foil 14, and the cutter 15 cuts the hair. The cut hair is filtered by the filter 18.

EMBODIMENT 1

This embodiment has space control means so that the space between the shearing foil and the skin can be adjusted. In practice, the means to adjust the space between the shearing foil and the skin can be useful. In order that hair can be effectively drawn in along with air, there must be a space between the shearing foil of an electric vacuum shaver and the skin. Otherwise hair, especially long hair, is pressed against the skin by the shearing foil of the shaver and has difficulty entering the shearing foil even though there is a vacuum inside it. Although more space between the shearing foil and the skin helps hair to be drawn in easily, more space between the shearing foil and the skin also means that hair cannot be shaved short. However, in most cases, hair needs be shaved as short as possible.

Figure 2:
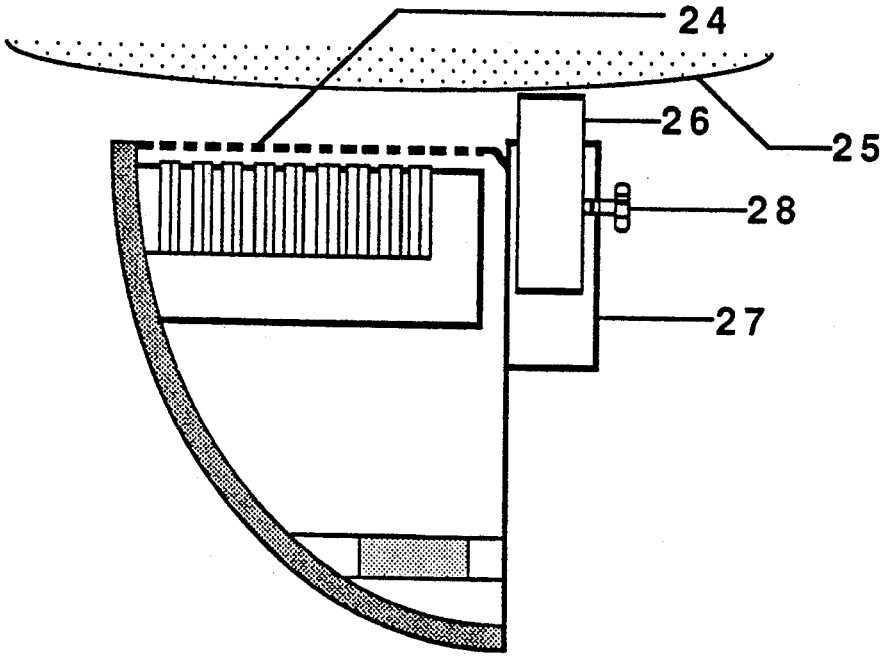
FIG. 2 shows space control means which adjusts the space between the skin and the shearing foil. The space between the skin and the shearing foil is adjusted by changing the position of the enclosure within the receptacle. In this case, the enclosure is fixed at a certain height using a screw so that long hair can be easily drawn in and cut to an intermediate length without being pressed.
Figure 3:
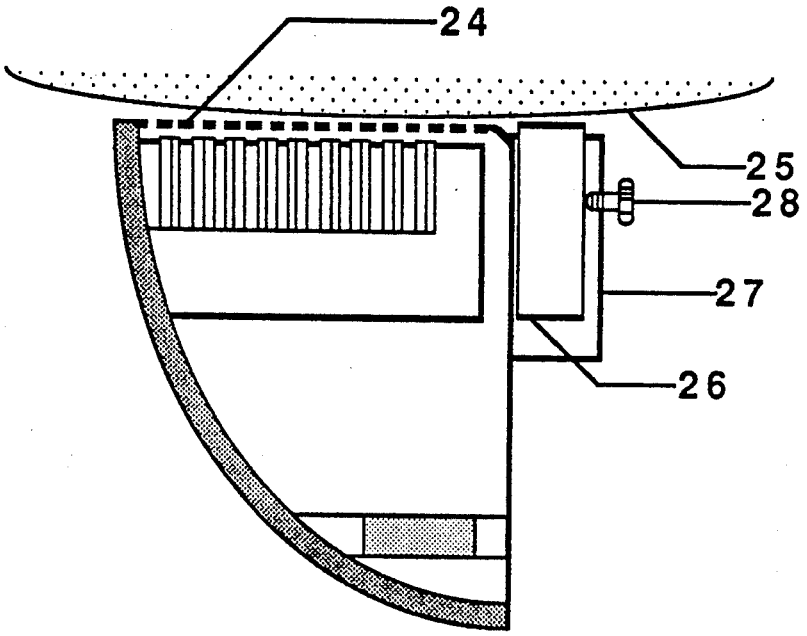
FIG. 3 shows space control means which adjusts the space between the skin and the shearing foil. In this case, the enclosure is fixed at about the same height as the shearing foil so that hair can be shaved skin close.
Figure 4:
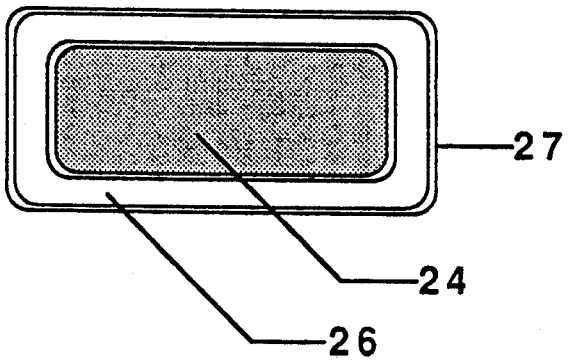
FIG. 4 shows a top view of an electric vacuum shaver. In this example, the receptacle and the enclosure are placed on the entire circumference of the shearing foil.
Figure 5:
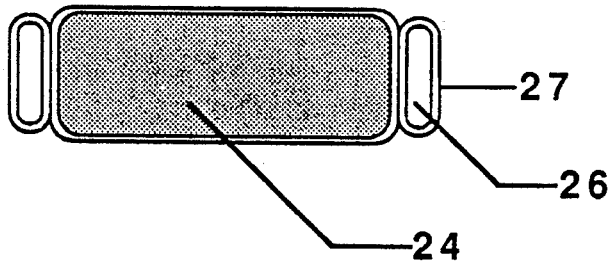
FIG. 5 shows a top view of an electric vacuum shaver. In this example, the receptacle and the enclosure are placed on parts of the circumference of the shearing foil.

This problem can be overcome by employing means to adjust the space between the shearing foil and the skin. For instance, in the first operation, the user can set the space between the shearing foil and the skin wide enough so that long hair can enter easily through the shearing foil without a risk of being pressed, and be cut to an intermediate length. Since the hair is now cut relatively short, there is now little risk that the hair will be pressed, so the space can be reduced further so that hair can be shaved skin close in the second operation. FIG. 2 shows an example of the space control means which adjusts the space between the shearing foil 24 and the skin 25. The space control means comprises an enclosure 26, a receptacle 27 and changing means to change the position of the enclosure 26 within the receptacle 27. In FIG. 2, the enclosure 26 is fixed at a certain height within the receptacle 27 by the screw 28 so that there is enough space between the shearing foil 24 and the skin 25. Thus hair can be effectively drawn in and cut to an intermediate length. Then the space is reduced so that the hair can be shaved skin close as shown in FIG. 3. It is also possible to attach a motor to change the position of the enclosure 26 within the receptacle 27. The receptacle 27 and the enclosure 26 can be placed on the circumference of the shearing foil 24 as shown in FIG. 4 or they can be placed on parts of the circumference of the shearing foil 24 as shown in FIG. 5. In the second case, the receptacle and enclosure do not necessarily enclose the shearing foil.

EMBODIMENT 2

Figure 6:
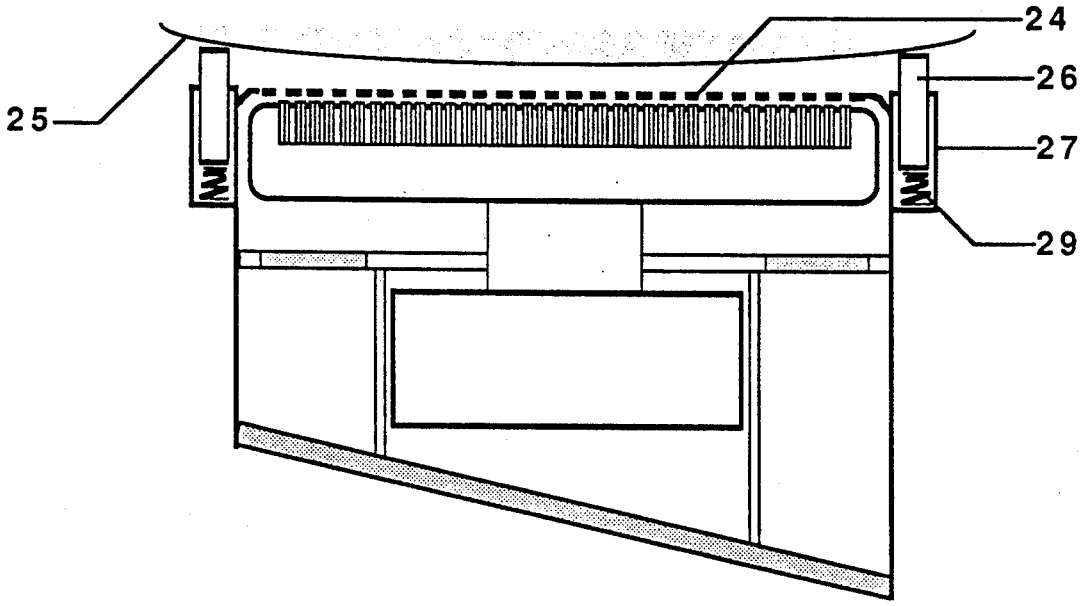
FIG. 6 shows space control means which controls the space between the skin and the shearing foil automatically according to the force applied on the enclosure. As the user presses the shaver, the enclosure is pushed into the receptacle and the space between the skin and the shearing foil is reduced resulting in a close shave.

This embodiment has an automatic space control means which adjusts the space between the shearing foil and the skin automatically according to the force applied to the enclosure of an electric vacuum shaver. FIG. 6 shows an example of the automatic space control means. The automatic space control means comprises an enclosure 26, a receptacle 27 and an elastic body 29 which changes the position of the enclosure 26 within the receptacle 27 according to the force applied on the enclosure 26. The user can cut hair to an intermediate length with little force applied on the enclosure 26, and then shave the hair skin close by applying more force on the enclosure 26. The receptacle 27 and the enclosure 26 can be placed on the circumference of the shearing foil 24 as shown in FIG. 4 or they can be placed on parts of the circumference of the shearing foil 24 as shown in FIG. 5. It is also possible to attach means to fix the enclosure within the receptacle.

Figure 7:
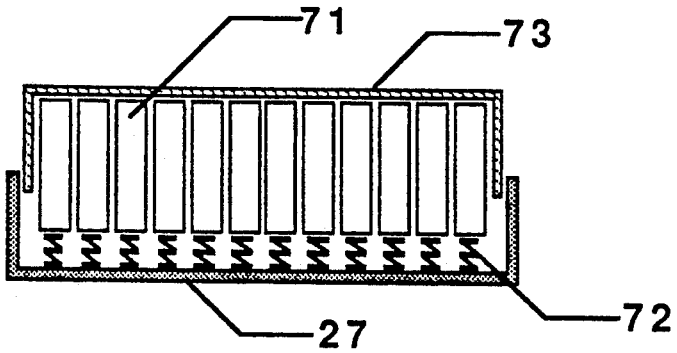
FIG. 7 shows a cross-sectional view of automatic space control means having an enclosure which can conform to the shape of the skin more exactly.
Figure 8:
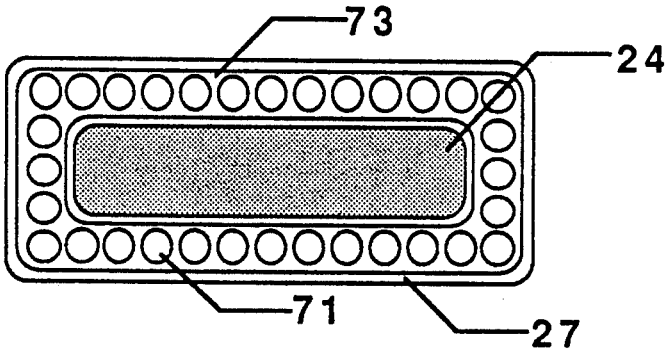
FIG. 8 shows a top view of automatic space control means having an enclosure which can conform to the shape of the skin more exactly.

The automatic space control means can be designed so that it can conform to the shape of the skin in detail as shown in FIG. 7. In this case, the enclosure comprises a number of bars 71, a flexible cover 73, and a number of elastic bodies 72 between the bars and the receptacle 27. FIG. 8 shows a top view of such automatic space control means. It is also possible not to use the cover or cover each bar individually. In general, the tip of the enclosure can be covered with a flexible or elastic material such as rubber and sponge.

EMBODIMENT 3

Figure 9:
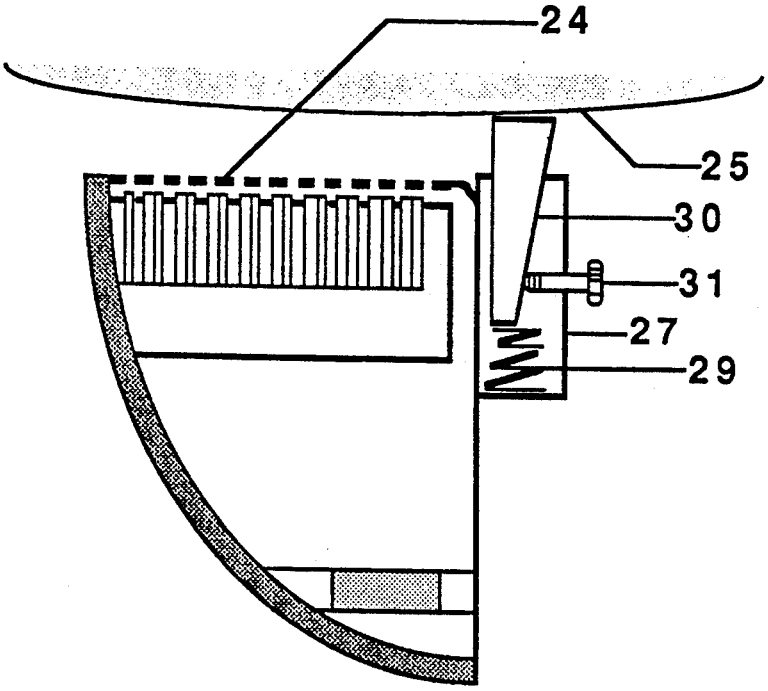
FIG. 9 shows space control means which controls the space between the skin and the shearing foil automatically according to the force applied on the enclosure with means to control the maximum closeness. By adjusting the screw which determines how deep the enclosure can be pushed into the receptacle, the user can control the closeness. In this case, the screw is adjusted so that some space is guaranteed regardless of the force applied on the shaver. As a result, long hair can be easily drawn in and cut to an intermediate length.
Figure 10:
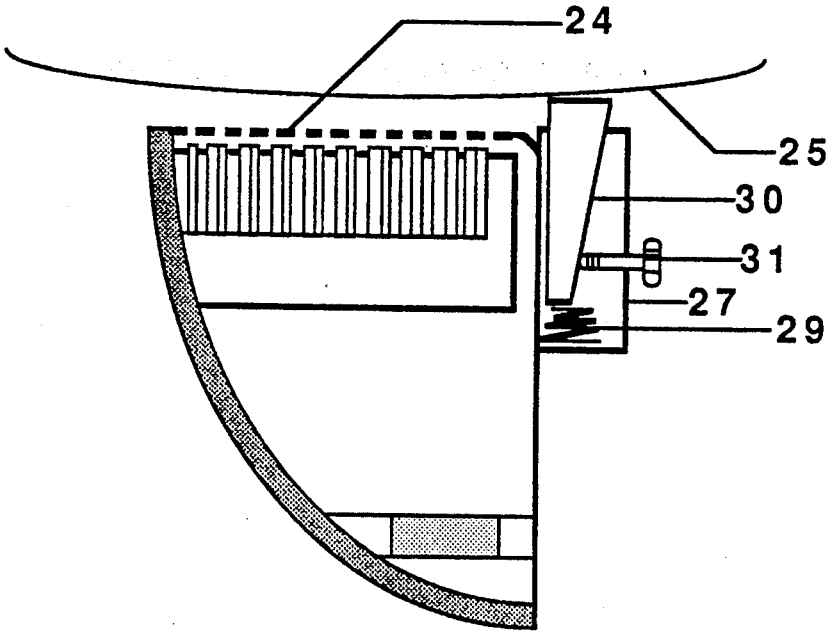
FIG. 10 shows space control means which controls the space between the skin and the shearing foil automatically according the force applied on the enclosure with means to control the maximum closeness. In this case, the screw is adjusted so that hair can be shaved skin close.

This embodiment shows an example of automatic space control means with means to restrict the depth that the enclosure can be pushed into the receptacle. By restricting the depth that the enclosure can be pushed into the receptacle, a minimum space between the shearing foil and the skin is guaranteed no matter how much force is applied to the enclosure. FIG. 9 and FIG. 10 show an example of automatic space control means with means to restrict the depth that the enclosure 30 can be pushed into the receptacle 27. In this example, restricting the depth is achieved by using a tapered enclosure 30 and a screw 31. In FIG. 9, the screw 31 is adjusted so that a minimum space is guaranteed no matter how much force is applied. As a result, long hair can be easily drawn in and cut to an intermediate length without being pressed no matter how much force is applied to the enclosure 30. Then the screw 31 is adjusted so that the enclosure 30 can be pressed to about the same height as the shearing foil 24 as shown in FIG. 10. Thus the hair can be shaved skin close.

By changing the direction of the tapering, it is also possible to guarantee a maximum space between the shearing foil and the skin even though no force is applied to the enclosure. This automatic space control means with restricting means to guarantee a minimum or maximum space between the shearing foil and the skin will be useful for shaving hair to a certain length or for various conditions of hair.

EMBODIMENT 4

Figure 11:
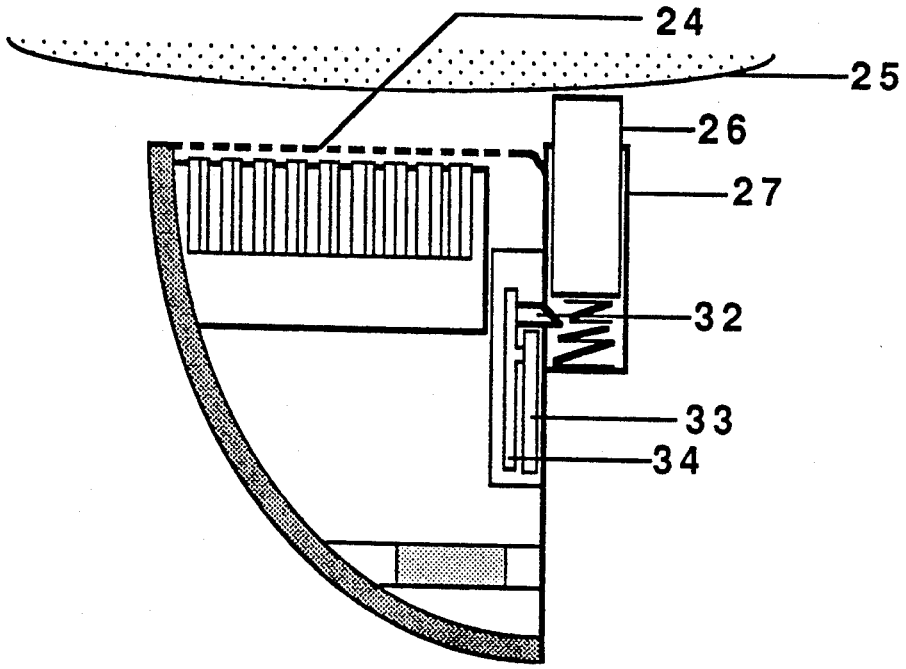
FIG. 11 shows disconnecting means which automatically disconnects power to the fan when the enclosure is pushed into the receptacle beyond a certain point. In other words, if the space between the shearing foil and the skin is smaller than a threshold, power to the fan is disconnected, to prevent the shearing foil from sticking to the skin.
Figure 12:
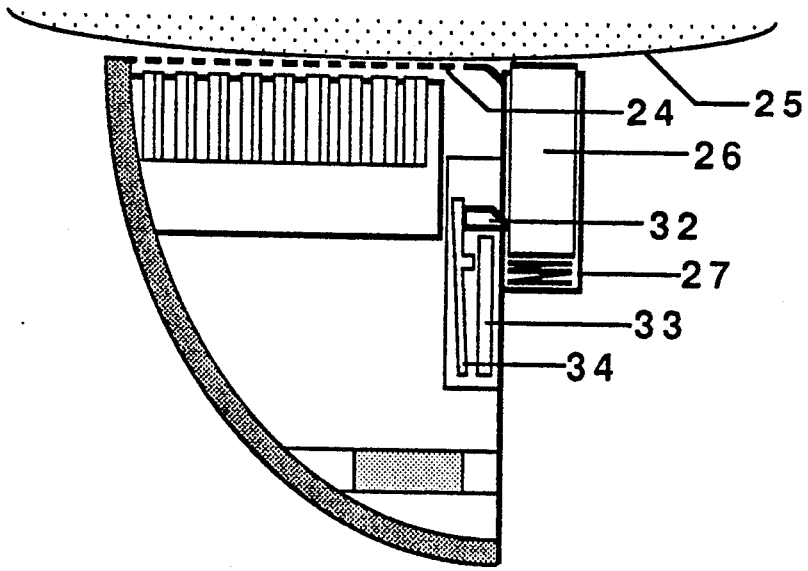
FIG. 12 shows how the disconnecting means works. As the enclosure is pushed in the receptacle beyond a certain point, the enclosure pushes a part of an electrode so that the two electrodes are disconnected.

Even though drawing air though the shearing foil can draw in long hair and effectively shave it, there is a problem when the shearing foil and the skin are too close or in contact. If there is little or no space between the shearing foil and the skin, the shearing foil tends to stick to the skin causing discomfort, and difficulty moving the shaver over the skin. This problem is overcome by disconnecting means which automatically disconnects power to the fan when the shearing foil and the skin are too close or in contact. FIG. 11 shows an example of the disconnecting means which disconnects power to the fan when the shearing foil 24 and the skin 25 are too close or in contact. When the enclosure 26 is pushed into the receptacle 27 more than a threshold, the enclosure 26 in turn pushes a projecting part 32 of an electrode 34 so that the two electrodes 33, 34 are disconnected, turning off the fan as shown in FIG. 12. Thus the user can cut long thin hair to an intermediate length utilizing the vacuum. Since the hair which is cut to an intermediate length is now short, the hair can easily enter through the shearing foil without vacuum. Then the user can press the shaver and shave the hair skin close. Since the disconnecting means disconnects power to the fan when the shearing foil is close or in contact with the skin, the shearing foil will not stick to the skin nor cause any discomfort. It is also possible to turn off the fan by adding an extra switch for the fan. Then the user can turn the fan on or off depending on situation.

Figure 13:
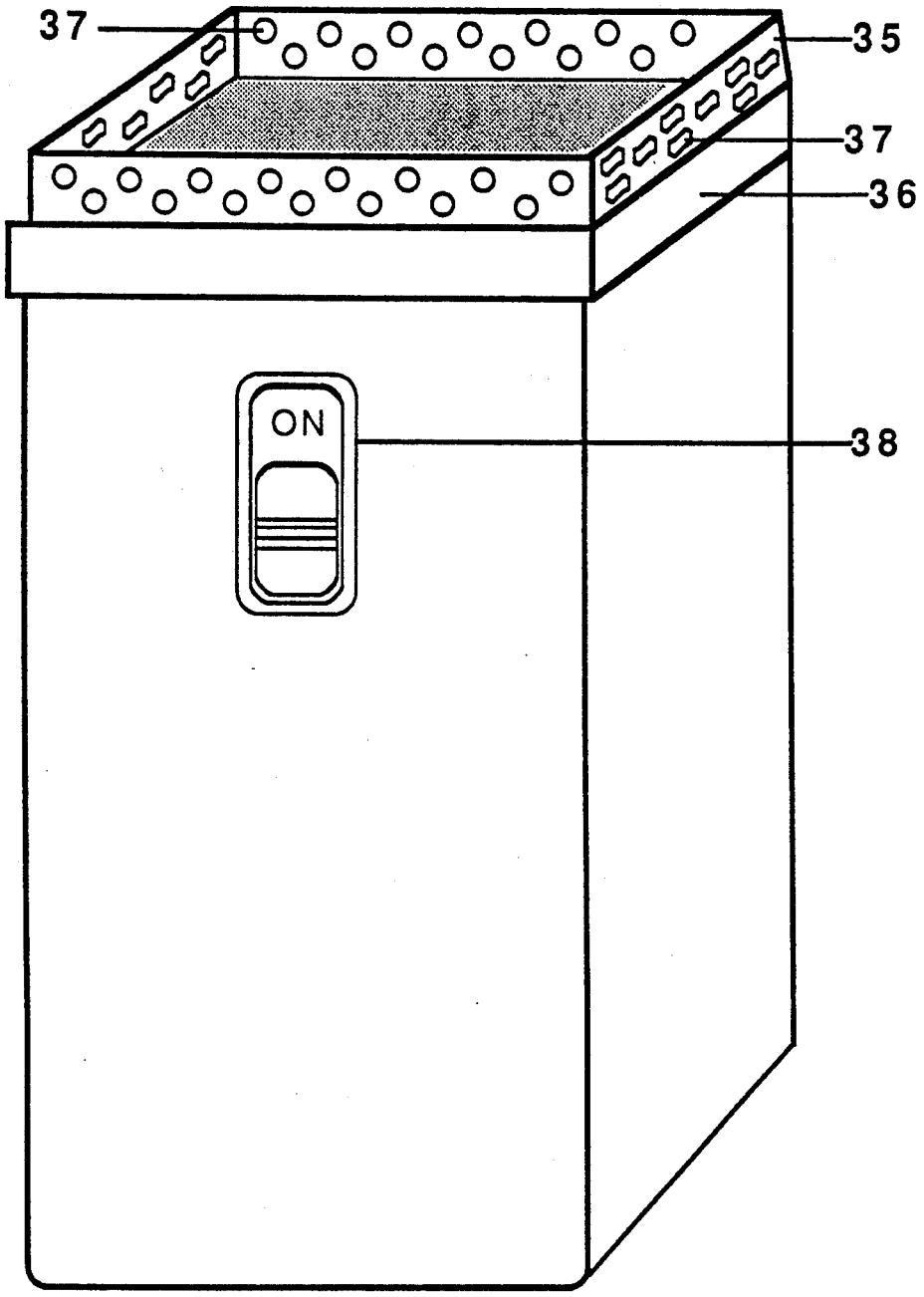
FIG. 13 shows a perspective view of an electric vacuum shaver.

FIG. 13 shows a pespective look of the electric vacuum shaver with an on-off switch 38. The enclosure 35 can be pushed into the receptacle 36 and the enclosure 35 has openings 37 to allow air to flow through. The function of the enclosure 35 is twofold. First, the enclosure 35 controls the space between the shearing foil and the skin. Secondly, by increasing the degree of vacuum between the shearing foil and the skin, the enclosure 35 makes it possible to utilize the vacuum more effectively.

EMBODIMENTS 5

It is shown that by adjusting the space between the shearing foil and the skin, the user can cut long hair to any desirable length. However, it may be necessary to change the space between the shearing foil and the skin several times in order to cut long hair to a desirable length. In order to shave long hair skin close in one operation, an electric vacuum shaver with a slanted shearing foil is also provided.

Figure 14:
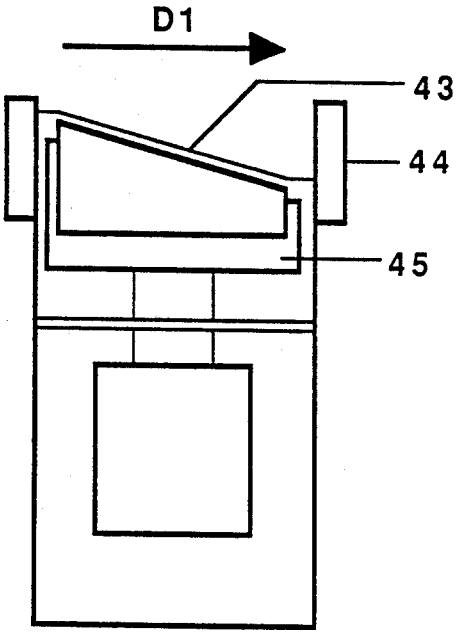
FIG. 14 shows an electric vacuum shaver which has a slanted shearing foil so that long hair can be gradually shaved skin close in one operation.
Figure 15:
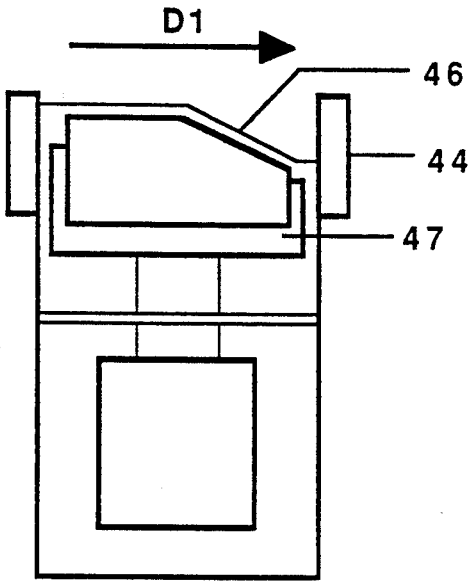
FIG. 15 shows an electric vacuum shaver whose shearing foil is flat in part and slanted in the other part so that long hair can be shaved skin close in one operation. By increasing the flat area of the shearing foil, hair can be shaved skin close more effectively.

FIG. 14 shows an example of such an electric vacuum shaver having a slanted shearing foil 43, and an enclosure 44 which maintains a proper distance between the shearing foil and the skin. The cutter 45 is designed to conform to the shape of the shearing foil 43 and cooperate with the shearing foil 43. As the user moves the shaver over the skin in one direction D1, long hair is gradually shaved skin close. FIG. 15 shows an example which has a shearing foil 46 half of which is slanted and the other half is flat so that hair can be shaved short more effectively. The cutter 47 is designed to cooperate with the shearing foil. By increasing the flat area of the shearing foil, hair can be shaved short more effectively, and the enclosure 44 ensures desirable distance between the shearing foil and the skin, making it possible to utilize the vacuum more effectively. However, the embodiments shown in FIG. 14 and FIG. 15 are direction dependent. In other words, the shaver must be moved in a certain direction D1.

Figure 16:
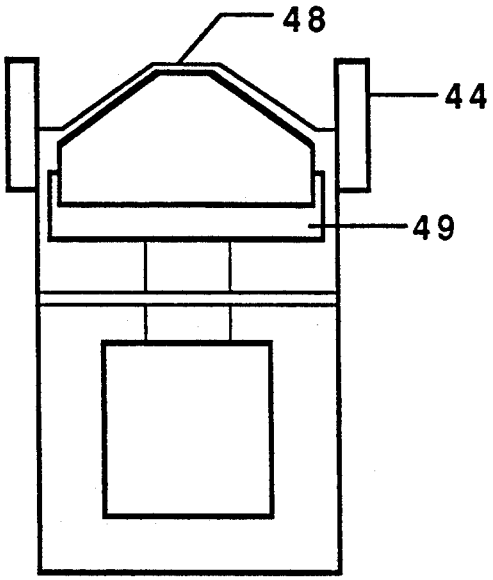
FIG. 16 shows an electric vacuum shaver whose shearing foil is flat in the middle and slanted in the rim so that long hair can be shaved short in one operation regardless of the direction in which the shaver is moved.
Figure 17:
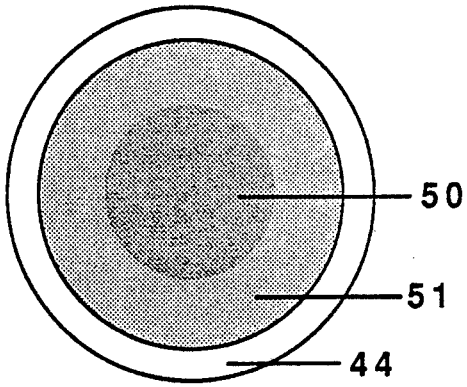
FIG. 17 shows a top view of a shearing foil which is flat in the middle and slant in the rim.

In order to make the shaver direction independent, the shearing foil can be designed to be flat in the middle and slanted in the rim. FIG. 16 shows a cross-sectional view of a shaver whose shearing foil 48 is flat in the middle and becomes slanted in the rim. The enclosure 44 maintains a proper distance between the shearing foil and the skin. The cutter 49 is designed to conform to the shape of the shearing foil 48 and cooperate with the shearing foil 48. FIG. 17 shows a top view of the shearing foil which is flat in the middle 50 and becomes slanted in the rim 51. In this case, no matter what direction the user moves the shaver, long hair is shaved short gradually from the rim 51 of the shearing foil to the center 50.

Figure 18:
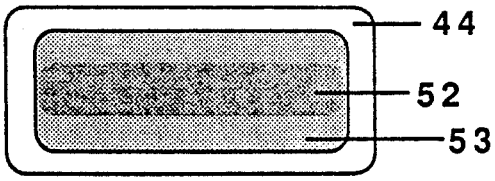
FIG. 18 shows a top view of a rectangular shearing foil which is flat in the middle and slanted in the rim. This design of a shearing foil provides more shaving area in a particular direction.
Figure 19:
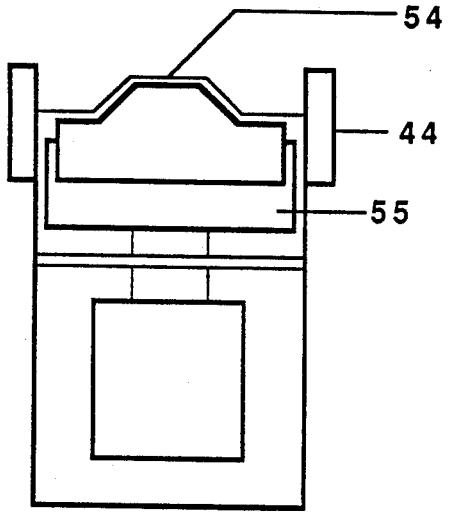
FIG. 19 shows an electric vacuum shaver whose shearing foil is flat in the middle and in the rim and slanted in between so that long hair can be shaved short in one operation regardless of the direction in which the shaver is moved.
Figure 20:
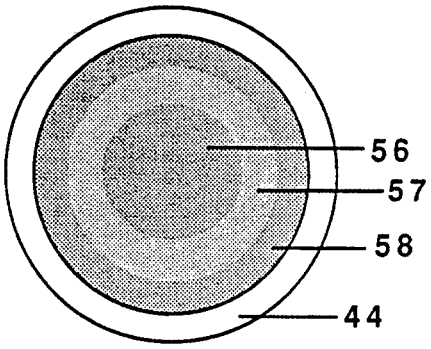
Figure 21:
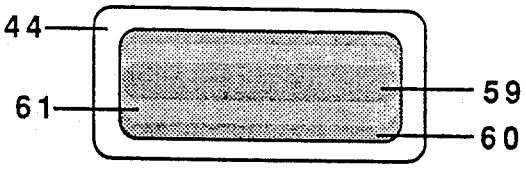
FIG. 21 shows a top view of a rectangular shearing foil which is flat in the middle and in the rim and slanted in between. This design of a shearing foil provides more shaving area in a particular direction.

However, in many cases, the shaver need not be truly direction independent. In most cases, it would be fine for the shaver to be operated in two directions. FIG. 18 shows a rectangular shearing foil which is flat in the middle 52 and slanted in the rim 53, to provide more uniform shaving area than shown in FIG. 17. FIG. 19 shows another variation of a shearing foil. In this example, the shearing foil is flat in the middle and in the rim, and slanted in between so that long hair can be shaved more effectively. The enclosure 44 maintains a proper distance between the shearing foil and the skin. The cutter 55 is designed to conform to the shape of the shearing foil 54 and cooperate with the shearing foil 54. FIG. 20 shows a top view of the shearing foil which is flat in the middle 56 and in the rim 58, and slanted in between 57. FIG. 21 shows a rectangular shearing foil which is flat in the middle 59 and in the rim 60, and slanted in between 61.

EMBODIMENT 6

Figure 22:
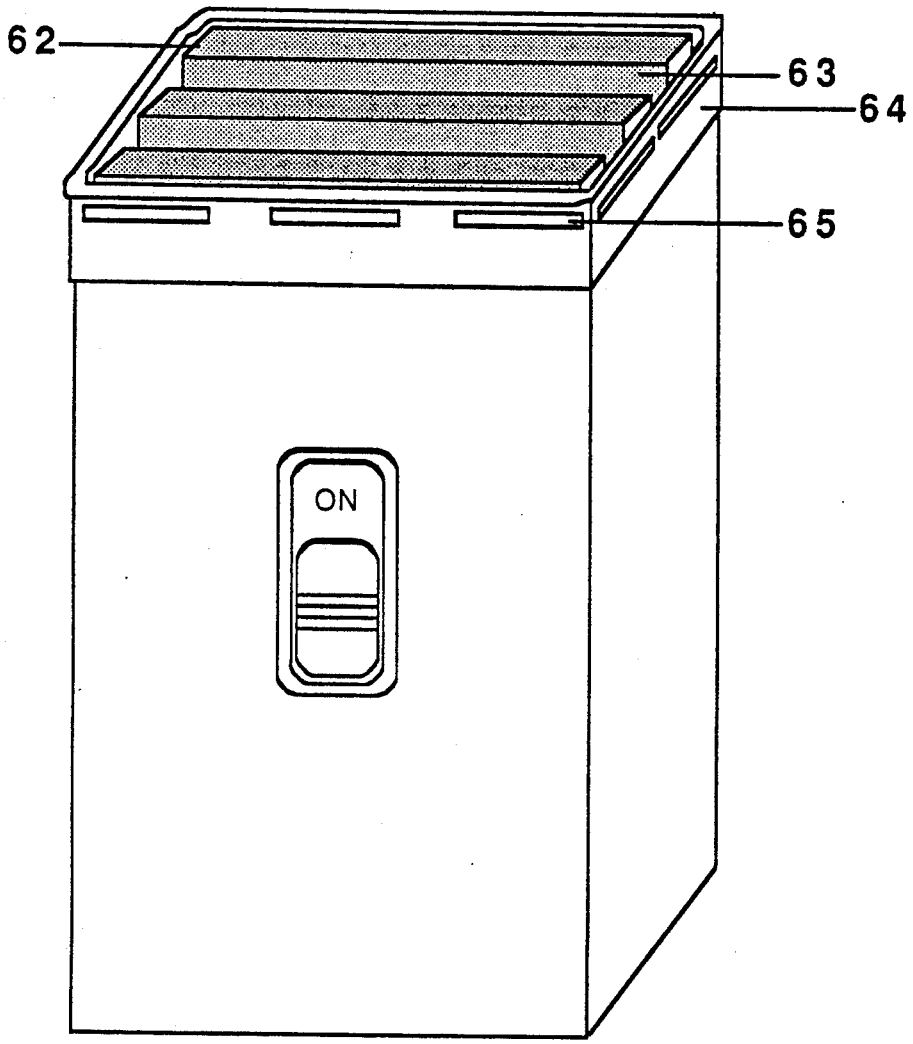
FIG. 22 shows a perspective view of an electric vacuum shaver. Some parts of the shearing foil of the shaver are flat and at about the same height as the enclosure and other parts of the shearing foil are flat and lower than the enclosure.
Figure 23:
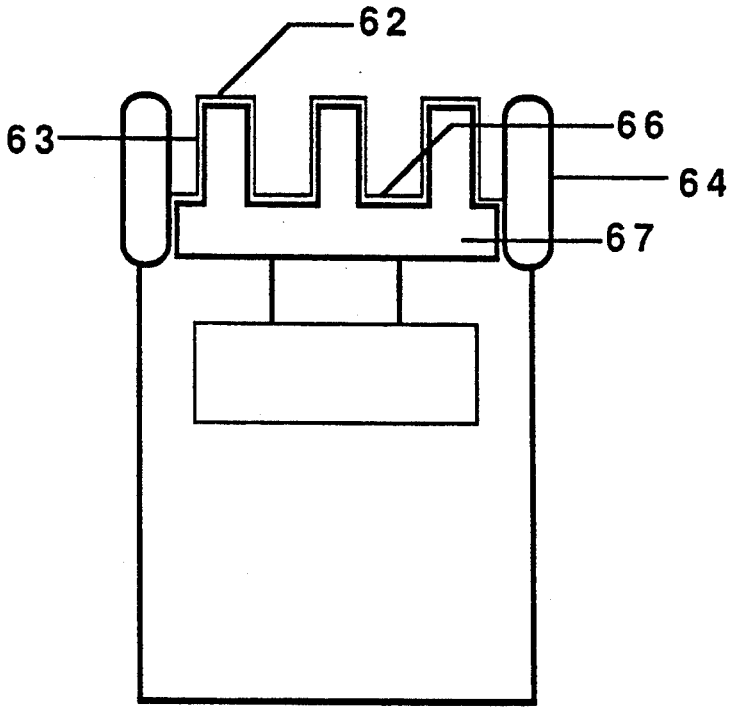
FIG. 23 shows a cross-sectional view of an electric vacuum shaver whose shearing foil is in part at about the same height as the enclosure and in part lower than the enclosure.

FIG. 22 shows another electric vacuum shaver which makes it possible to shave long hair short in one operation. The shape of the shearing foil is specially designed so that parts 62 of the shearing foil are at the same height as the enclosure 64 and parts 63 of the shearing foil are lower than the enclosure 64. The enclosure has opening 65. FIG. 23 shows a cross-sectional view of the shaver.

Figure 24:
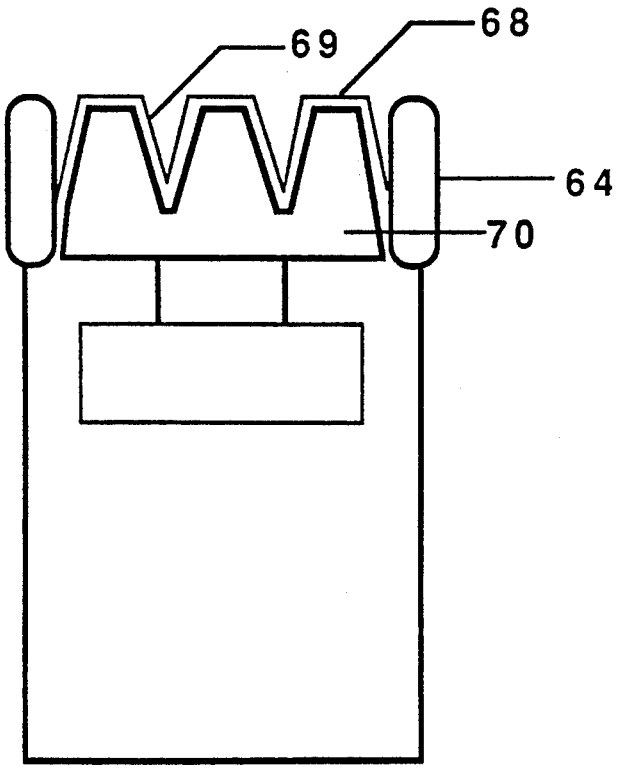
FIG. 24 shows a cross-sectional view of an electric vacuum shaver whose shearing foil has several flat parts and is slanted between the flat parts.

The shearing foil has several high parts 62 which are at about the same height as the enclosure 64, several low parts 66 which are lower than the height of the enclosure 64 and perpendicular or nearly perpendicular parts 63 which connect the high parts 62 and the low parts 66. The cutter 67 is designed to conform to the shape of the shearing foil and cooperate with the shearing foil. Thus long hair will be cut to an intermediate height at the low parts 66 and the perpendicular parts 63 and then the hair will be shaved skin close at the high parts 62. FIG. 24 shows a cross-sectional view of an electric vacuum shaver whose shearing foil has several high parts 68 which are at about the same height as the enclosure 64 and slanted parts 69 in between. The cutter 70 is designed to conform to the shape of the shearing foil and cooperate with the shearing foil. It is possible to use both the space control means to adjust the space between the skin and the shearing foil, along with the slanted shearing foil for a maximum performance.

I claim:

1. An electric vacuum shaver comprising:

a shaver housing;

a head casing removably mounted on said shaver housing;

a shearing foil attached to said head casing;

a cutter cooperating with said shearing foil;

vacuum creating means to create a vacuum inside said shearing foil so that hair, regardless of length and thickness, is easily drawn in through said shearing foil, comprising a fan connected by a shaft to an electric motor which drives the fan;

filter means which is disposed between said cutter and said vacuum creating means, and blocks cut hair while allowing air to flow; and space control means placed on a circumference of said shearing foil, which helps utilize the vacuum more effectively and maintains said shearing foil out of contact with skin so that long hair is effectively drawn into said shearing foil without being pressed.

2. The electric vacuum shaver in accordance with claim 1 wherein said space control means comprises a receptacle placed on the circumference of said shearing foil, an enclosure which is moveably placed within the receptacle and is able to be elevated above said shearing foil and to be pushed into the receptacle to about an equal level as said shearing foil, and changing means to change positions of the enclosure within the receptacle comprising a screw which fixes the enclosure at a desirable position within the receptacle.

3. An electric vacuum shaver comprising:

a shaver housing;

a head casing removably mounted on said shaver housing;

a shearing foil attached to said head casing;

a cutter cooperating with said shearing foil;

vacuum creating means to create a vacuum inside said shearing foil so that hair, regardless of length and thickness, is easily drawn in through said shearing foil, comprising a fan connected by a shaft to an electric motor which drives the fan;

filter means which is disposed between said cutter and said vacuum creating means, and blocks cut hair while allowing air to flow; and automatic space control means placed on a circumference of said shearing foil, which helps utilize the vacuum more effectively and automatically maintains said shearing foil out of contact with skin so that long hair is effectively drawn into said shearing foil without being pressed.

4. The electric vacuum shaver in accordance with claim 3 wherein said automatic space control means comprises a receptacle placed on the circumference of said shearing foil, an enclosure which is moveably placed within the receptacle and is able to be elevated above said shearing foil and to be pushed into the receptacle to about an equal level as said shearing foil, and an elastic body which is placed between the enclosure and the receptacle and changes positions of the enclosure within the receptacle according to force applied to the enclosure.

5. An electric vacuum shaver comprising:

a shaver housing;

a head casing removably mounted on said shaver housing;

a shearing foil attached to said head casing;

a cutter cooperating with said shearing foil;

vacuum creating means to create a vacuum inside said shearing foil so that hair, regardless of length and thickness, is easily drawn in through said shearing foil, comprising a fan connected by a shaft to an electric motor which drives the fan;

filter means which is disposed between said cutter and said vacuum creating means, and blocks cut hair while allowing air to flow; and restrictable automatic space control means placed on a circumference of said shearing foil, which automatically and restrictably adjusts space between skin and said shearing foil according to force applied on the shaver with restricting means to restrict limits for space between the skin and said shearing foil so that the vacuum is better utilized and said shearing foil is maintained out of contact with the skin to help long hair to be effectively drawn into said shearing foil without being pressed.

6. The electric vacuum shaver in accordance with claim 5 wherein said restrictable automatic space control means comprises a receptacle placed on the circumference of said shearing foil, an enclosure which is tapered and moveably placed within the receptacle and is able to be elevated above said shearing foil and to be pushed into the receptacle to about an equal level as said shearing foil, an elastic body which is placed between the enclosure and the receptacle and changes positions of the enclosure within the receptacle according to force applied to the enclosure; said restricting means to restrict limits for space between skin and said shearing foil comprising a screw placed in the receptacle which restricts space in which the tapered enclosure is able to move within the receptacle.

7. An electric vacuum shaver, comprising:

a shaver housing;

a head casing removably mounted on said shaver housing;

a shearing foil attached to said head casing;

a cutter cooperating with said shearing foil;

vacuum creating means to create a vacuum inside said shearing foil so that hair, regardless of length and thickness, is easily drawn in through said shearing foil, comprising a fan connected by a shaft to an electric motor which drives the fan;

filter means which is disposed between said cutter and said vacuum creating means, and blocks cut hair while allowing air to flow; and disconnecting means to disconnect power to said vacuum creating means when there is substantially no space between said shearing foil and skin, preventing said shearing foil from sticking to the skin.

8. The electric vacuum shaver in accordance with claim 7 wherein said disconnecting means comprises a receptacle placed on a circumference of said shearing foil of the shaver, an enclosure which is moveably placed within the receptacle and is able to be elevated above said shearing foil and to be pushed into the receptacle to about an equal level as said shearing foil, and two electrodes, one of which has a projecting part into the receptacle and is pushed by the enclosure away from the other electrode resulting in disconnection of power to said vacuum creating means when the enclosure is pushed into the receptacle beyond a threshold.

9. An electric vacuum shaver comprising:

a shaver housing;

a head casing removably mounted on said shaver housing;

a shearing foil which is partly slanted and partly flat attached to said head casing;

a cutter cooperating with said shearing foil;

vacuum creating means to create a vacuum inside said shearing foil so that hair, regardless of length and thickness, is easily drawn in through said shearing foil, comprising a fan connected by a shaft to an electric motor which drives the fan;

filter means which is disposed between said cutter and said vacuum creating means, and blocks cut hair while allowing air to flow; and automatic space control means placed on a circumference of said shearing foil, which helps utilize the vacuum more effectively and maintains said shearing foil out of contact with skin so that long hair is effectively drawn into said shearing foil without being pressed.

10. The electric vacuum shaver in accordance with claim 9 wherein said automatic space control means comprises a receptacle placed on the circumference of said shearing foil, an enclosure which is moveably placed within the receptacle and is able to be elevated above said shearing foil and to be completely pushed into the receptacle, and an elastic body which is placed between the enclosure and the receptacle and changes positions of the enclosure within the receptacle according to force applied to the enclosure.

11. The electric vacuum shaver in accordance with claim 10 wherein said shearing foil comprises a flat part which is at about an equal level as the receptacle so that hair is cut short, and a slanted part which begins at about an equal level as the receptacle and ends up substantially lower than the receptacle so that long hair is effectively drawn in and cut without being pressed.

12. An electric vacuum shaver comprising:

a shaver housing;

a head casing removably mounted on said shaver housing;

a shearing foil attached to said head casing;

a cutter cooperating with said shearing foil;

vacuum creating means to create a vacuum inside said shearing foil so that hair, regardless of length and thickness, is easily drawn in through said shearing foil, comprising a fan connected by a shaft to an electric motor which drives the fan;

filter means which is disposed between said cutter and said vacuum creating means, and blocks cut hair while allowing air to flow; and automatic space control means placed on a circumference of said shearing foil, which helps utilize the vacuum more effectively and maintains said shearing foil out of contact with skin so that long hair is effectively drawn into said shearing foil without being pressed.

13. The electric vacuum shaver in accordance with claim 12 wherein said automatic space control means comprises a receptacle placed on the circumference of said shearing foil, an enclosure which is moveably placed within the receptacle and is able to be elevated above said shearing foil and to be completely pushed into the receptacle, and an elastic body which is placed between the enclosure and the receptacle and changes positions of the enclosure within the receptacle according to force applied to the enclosure.

14. The electric vacuum shaver in accordance with claim 13 wherein said shearing foil comprises a number of high flat parts which are at about an equal level as the receptacle so that hair is cut short, a number of low flat parts which are substantially lower than the receptacle so that long hair is drawn in and cut without being pressed, a number of vertical parts which connect the high flat parts and the low flat parts so that hair is gradually cut short without being pressed.

* * * * *